US005606338A

United States Patent [19]

Takeda et al.

[11] Patent Number: 5,606,338

[45] Date of Patent: *Feb. 25, 1997

[54] DISPLAY CONTROL DEVICE

[75] Inventors: Hiroshi Takeda, Koganei; Shigeaki Yoshida, Sayama; Koyo Katsura, Hitachi, all of Japan

[73] Assignee: Hitachi, Ltd., Tokyo, Japan

[ * ] Notice: The term of this patent shall not extend beyond the expiration date of Pat. No. 4,720,708.

[21] Appl. No.: 309,411

[22] Filed: Sep. 20, 1994

Related U.S. Application Data

[63] Continuation of Ser. No. 749,331, Aug. 23, 1991, abandoned, which is a continuation of Ser. No. 454,272, Dec. 21, 1989, abandoned, which is a continuation of Ser. No. 144,279, Jan. 9, 1588, Pat. No. 4,904,990, which is a division of Ser. No. 686,594, Dec. 26, 1984, Pat. No. 4,720,708.

[30] Foreign Application Priority Data

Dec. 26, 1983 [JP] Japan ..... 58-243802

[51] Int. Cl.[6] ..... G09G 1/08

[52] U.S. Cl. ..... 345/13; 345/213

[58] Field of Search ..... 345/213, 200, 345/13; 340/721, 723, 724, 735, 747, 745, 750, 799, 814; 375/107; 370/100, 101, 102, 103; 358/152, 153

[56] References Cited

U.S. PATENT DOCUMENTS

| | | | |
|---|---|---|---|
| 3,898,377 | 8/1975 | Fairbairn et al. | 358/153 |
| 4,200,869 | 4/1980 | Murayama et al. | 340/723 |
| 4,309,700 | 1/1982 | Kraemer | 340/723 |
| 4,379,293 | 4/1983 | Boinsvert et al. | 340/814 |
| 4,434,420 | 2/1984 | Bujalski | 340/724 |
| 4,437,093 | 3/1984 | Bradley | 340/724 |
| 4,450,442 | 5/1984 | Tanaka | 340/721 |
| 4,484,187 | 11/1984 | Brown et al. | 340/721 |
| 4,491,832 | 1/1985 | Tanaka | 340/721 |
| 4,495,594 | 1/1985 | Eggebrecht et al. | 340/723 |
| 4,720,708 | 1/1988 | Takeda et al. | 340/814 |
| 4,899,139 | 2/1990 | Ishimochi et al. | 340/721 |
| 4,904,990 | 2/1990 | Takeda et al. | 340/814 |

FOREIGN PATENT DOCUMENTS

| | | |
|---|---|---|
| 5-141929 | 6/1921 | Japan . |
| 58-208845 | 12/1983 | Japan . |

*Primary Examiner*—Richard Hjerpe
*Assistant Examiner*—Chanh Nguyen
*Attorney, Agent, or Firm*—Antonelli, Terry, Stout & Kraus, LLP

[57] ABSTRACT

A CRT (cathode ray tube) controller for controlling one CRT device in an interlace mode has a synchronizing circuit of bi-directional construction, in order to make possible synchronous operation of the CRT controller with other circuits (other CRT controllers or a TV system). When the CRTC is used as a master circuit of a CRT display system, a synchronizing signal is derived from the synchronizing circuit in synchronization with a count signal of a vertical scanning counter and an output of an interlace controller of the CRTC, and is supplied to a synchronizing terminal of the other CRTCs. Scanning counters and a flip-flop for controlling an interlace operation of the other CRTCs are reset to their initial state in synchronization with the synchronizing signal. When the CRTC is used as a slave circuit, scanning counters and a flip-flop of the CRTC are reset to their initial state in synchronization with the external synchronizing signal.

60 Claims, 5 Drawing Sheets

A (Vst)
B (Hst)
C (Q1)
D (Vs)
E (Hs)
F (Q2)
G ($\overline{Q2}$)
H (PD)
I (Ex)

A (Vst)
B (Vs)
C (Ex)

DISPLAY CONTROL DEVICE

This is a continuation of application Ser. No. 07/749,331, filed Aug. 23, 1991, now abandoned; which is a continuation of application Ser. No. 07/453,272, filed Dec. 21, 1989, now abandoned; which is a continuation of applicatiion Ser. No. 07/144,279, filed Jan. 15, 1988, which issued as U.S. Pat. No. 4,904,990; which is a Divisional of application Ser. No. 06/686,594, filed Dec. 26, 1984, which issued as U.S. Pat. No. 4,720,708.

BACKGROUND OF THE INVENTION

This invention relates to control of the generation of data displays, and in particular to a technique which is especially effective when applied to a control device employed for the display of digital image data, for example, in a cathode ray tube (CRT) display device.

In order to cause a CRT display device to display image data which has been previously written in a memory by a computer or the like, for example, it is necessary to access the memory to read out this image data and to prepare synchronizing signals corresponding to the access period. If a sequence of these processing operations are assigned, for instance, to a CPU (central processing unit) of a computer system, the tasks of the CPU are increased, and thus the entire throughput thereof is greatly reduced. Display control devices which are exclusively used for executing these processing operations separately, namely the control of the memory and the preparation of synchronizing signals, have been proposed previously by the inventors and are embodied in display control device Models HD6845, HD68A45 and HD6845S of Hitachi, Ltd.

These display control devices are also called CRTCs. Each of these devices is provided with a scanning counter which is incremented at a period based on the timing of access to the memory, whose count is circulated periodically, and which has functions such that the memory can be accessed according to address data prepared on the basis of the count of the scanning counter and a horizontal synchronizing signal and a vertical synchronizing signal can each be generated based on the count of the scanning counter, so that image data stored in the memory can be displayed on a display device of a scanning system in which an image display screen is formed of horizontal scanning lines and vertical frames. Such a CRTC is formed of a semiconductor integrated circuit, and it is typically connected as a peripheral device to a system bus of a CPU, for example, when in use. This relieves the CPU of the task of display control, in terms of both hardware and software, and thus the throughput of the entire system can be increased.

The present inventors have examined a method in which, when a plurality of these CRTCs are used, image data stored in memories controlled by each of the CRTCs is superposed and displayed on one image display screen. The inventors have found, however, that it is insufficient to simply apply the same basic clock to each CRTC to provide a superposed display on one image screen. In a CRTC, horizontal and vertical synchronizing signals are generated to control the CRT display device. These synchronizing signals are generated by the scanning counter which counts a basic clock provided from the external equipment. Here, when a plurality of CRTCs each generate identical synchronizing signals based on the same basic clock, the phases of these synchronizing signals do not always agree with each other. For example, once the count of the scanning counter in any one of the differs from those in the other CRTCs, this difference appears as a phase difference between the synchronizing signals, and this state is not automatically corrected, but remains. As a result, the positional relationships of the superposed images, or the synchronization thereof, is disrupted.

SUMMARY OF THE INVENTION

An object of the present invention is to provide a display technique which enables a superposed display of a plurality of image data items controlled by each of a plurality of CRTCs, within one image display screen, with the prescribed mutual positional relationships thereof maintained.

An additional object of the present invention is to provide a display technique which enables the superposed display on one image display screen of image data displayed by a display system, such as a television system, which has a separate synchronizing signal system, and image data controlled by a CRTC, with a prescribed mutual positional relationship thereof maintained.

The objects of the present invention are achieved by a method in which the count of a scanning counter provided for generating synchronizing signals in a CRTC is periodically initialized forcibly to a prescribed value by an external signal, so that any phase difference between the synchronizing signals in the CRTC and external synchronizing signals is modified periodically or whenever appropriate, and thus a plurality of image data can be displayed in superposed relationship with the mutual positional relationships thereof maintained.

DETAILED DESCRIPTION OF THE PREFERRED EMBODIMENTS

Typical embodiments of the present invention will be described hereunder with reference to the drawings, in which identical or equivalent elements are denoted by the same symbols.

Figure 1:
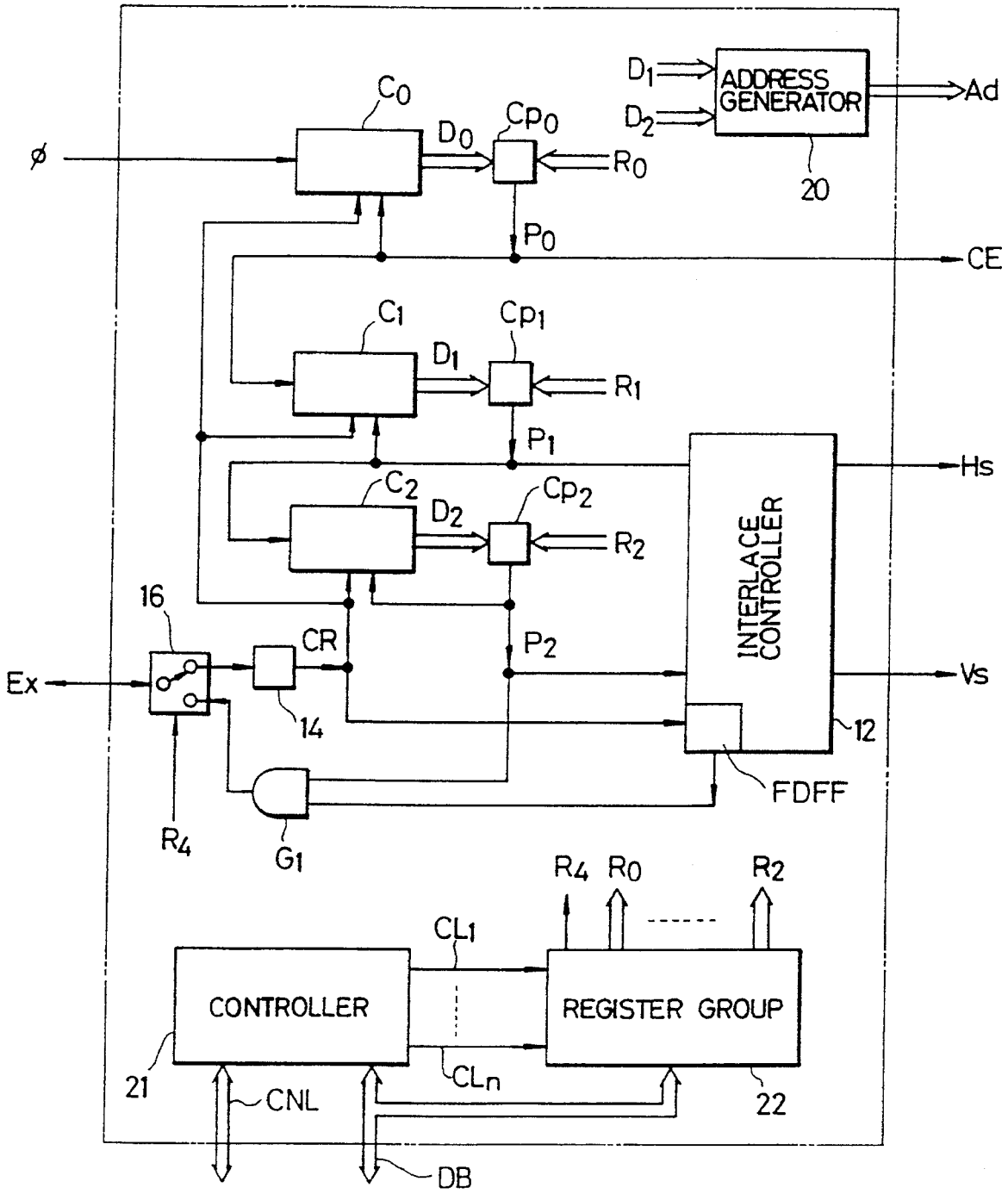
FIG. 1 is a schematic diagram of one embodiment of a display control device of the present invention.

FIG. 1 shows one embodiment of a display control device in accordance with the present invention.

The display control device 10, called a CRTC, is provided with scanning counters $C_1$ and $C_2$ which are incremented at a rate based on the timing of access to a memory containing the data to be displayed, and the counts of these counters are circulated (reset or initialized) periodically so that image data stored in the memory can be displayed on the screen of a display device having a scanning system in which an image display is formed of horizontal scanning lines and vertical frames. The memory is accessed by address data Ad generated by an address generator 20 on the basis of count content $D_1$ and $D_2$ of the scanning counters $C_1$ and $C_2$, respectively. Simultaneously, a horizontal synchronizing signal Hs and a vertical synchronizing signal Vs are also generated at the output of an interlace controller 12 on the basis of the counts $D_1$ and $D_2$ of the scanning counters $C_1$ and $C_2$, respectively. The counts of the scanning counters $C_1$ and $C_2$ may be initialized to prescribe values by an external signal Ex.

Here, the scanning counters $C_1$ and $C_2$ are comprised of a first scanning counter $C_1$ providing an output $D_1$ for synchronizing the horizontal scanning lines and a second scanning counter $C_2$ providing $D_2$ for synchronizing the vertical frames, and these counters $C_1$ and $C_2$ may be initialized together by the external signal Ex so that their counts have been prescribed values at the start of each display frame, for example.

The display control device 10 is formed of a semiconductor integrated circuit (LSI circuit), and is constructed so that it may be connected to a system bus of a CPU, for instance, as a peripheral device as will be described in more detail later with reference to FIG. 3. A CRT display device of an interlace (jump) scanning system may be employed as the display device. The memory is a so-called refresh memory or a video RAM (VRAM), and a RAM (random-access memory) is generally used therefor.

A more detailed description will be made hereunder with reference to FIG. 1. In addition to the first and second scanning counters $C_1$ and $C_2$, the device shown in this figure is provided with an access timing detection counter $C_0$, data comparator circuits $CP_0$, $CP_1$, and $CP_2$, the address generation circuit 20, an interlace control circuit 12, a pulse cut-out circuit 14, a terminal-switching circuit 16, and an AND gate $G_1$. A group of control registers 22 which can be written from externally are provided, and various operating modes of the display control device 10 are set or selected according to data written into this group of registers 22 under control of the CPU via controller 21. Comparison reference values $R_1$ and $R_2$ of the data comparator circuits $CP_1$ and $CP_2$ and a control signal $R_4$ used for setting the switching position of the terminal-switching circuit 16 are set by this group of control registers 22.

The controller 21 has an address register (not shown) for selecting one register of the register group 22, input control terminals CNL for receiving control signals (such as a read/write signal, a chip select signal, and a register select signal for selecting the address register or the register group), data input terminals DB, and output terminals $CL_1$ to CLn.

The register group has output terminals $R_0$ to $R_4$, plural registers corresponding to the output terminals $R_0$ to $R_4$, a bi-directional data terminal connected to the input terminals DB and control signal inputting terminals connected to the output terminals $CL_1$ to CLn of the controller 21.

In a CRT display system, the input control terminals CNL are connected to an address bus line of a CPU system, and the input terminals DB are connected to a data bus line of the same. When the control signals at the control terminals CNL are directed to a writing state of the address register (chip select signal $\overline{CS}$ at the select level (e.g. low), register select signal RS at the select level of the address register (e.g. low), and read/write signal R/W at the writing level (e.g. low)), the address register is selected. Thus, the register selection data for selecting one register of the register group 22 is written into the address register through the input terminals DB. After this operation, the control signals are changed to a writing state of the register group 22 (register select signal RS is changed to a select level of the register group 22 (e.g. high)), then one register of the register group is selected in accordance with the content of the address register in the controller 21. Accordingly, control data is written into the designated register of the register group 22 through the input terminals DB. Control data $R_0$ to $R_4$ is written into each register of the group 22 by repetition of this operation.

Display sizes (horizontal size and vertical size) of the display panel are determined by the data $R_1$ and $R_2$ since the pulse period of the pulse signal $P_1$ and the pulse period of the pulse signal $P_2$ are determined by the data $R_1$ and $R_2$.

A basic clock $\phi$ is first inputted to the display control device 10. The basic clock $\phi$ is synchronized with the clock of the system to which the display control device 10 is connected, for instance. The basic clock $\phi$ acts as a count input to the access timing detection counter $C_0$. The counter $C_0$ is incremented by the basic clock 4, and when a count $D_0$ thereof exceeds a comparison reference value $R_0$ of the data comparator circuit $CP_0$, it is reset so that it restarts counting from an initial value (0). In other words, the count $D_0$ circulates periodically. During each circulation period thereof, a pulse signal $P_0$ is outputted, as an access control signal CE for the memory (RAM) storing image data, to external equipment from the data comparator circuit $CP_0$. The memory is accessed thereby within each prescribed period, and one word of image element data (e.g. 8 bits or 16 bits) is read therefrom at each repeat of the access timing.

The pulse signal $P_0$ also acts as a count input to the first scanning counter $C_1$. This counter $C_1$ is designed so that it is incremented by the input pulse signal $P_0$ and, when the count $D_1$ thereof exceeds the comparison reference value $R_1$ of the data comparator circuit $CP_1$, it is reset so that it restarts counting from an initial value (0). In other words, the count $D_1$ is designed to circulate periodically. A pulse signal $P_1$ outputted from the data comparator circuit $CP_1$ during each circulation period of the count $D_1$ passes through the interlace control circuit 12 and is outputted externally as the horizontal synchronizing signal Hs for the CRT display device. In this case, the circulation period of the first scanning counter $C_1$ is made to correspond to the period at which image data for one horizontal scan is read from the memory. In other words, the comparison reference value $R_1$ is set so that the count $D_1$ of the first scanning counter $C_1$ returns to the initial value (0) when image data for one scanning line of the raster has been read therefrom.

The pulse signal $P_1$ outputted in each circulation period of the first scanning counter $C_1$ acts as a count input to the second scanning counter $C_2$. This counter $C_2$is incremented by the input pulse signal $P_1$ and, when the count $D_2$thereof exceeds the comparison reference value $R_2$ of the data comparator circuit $CP_2$, it is reset so that it restarts counting from an initial value (0). In other words, the second scanning counter $C_2$ is also designed so that its count $D_2$ circulates periodically. A pulse signal $P_2$ outputted from the data comparator circuit $CP_2$ during each circulation period of the count $D_2$ passes through the interlace control circuit 12 and is outputted externally as the vertical synchronizing signal Vs of the CRT display device. In this case, the circulation period of the second scanning counter $C_2$, is made to correspond to the period at which image data for one field is read from the memory. In other words, the comparison reference value $R_2$ is set so that the count $D_2$ of the second scanning counter $C_2$ returns to the initial value (0) when the image data corresponding to half the total number of horizontal lines constituting an image display have been read therefrom. Consequently, every time the circulation period of the second scanning counter $C_2$ is repeated twice, image data for two fields, i.e., for one frame, is read out and displayed on the CRT display device by an interlace system. When a display is produced by a CRT display device of a standard television system, for instance, approximately sixty vertical synchronizing signals Vs are generated each second, and thus thirty frames are produced per second.

The counts $D_1$ and $D_2$ of the first and second scanning counters $C_1$ and $C_2$ are applied to the address generation circuit 20. The address generation circuit produces the address data Ad for accessing the memory from these two counts $D_1$ and $D_2$. The image data stored in the memory is thereby read out in synchronization with the synchronizing signals Hs and Vs.

The interlace control circuit 12 provides scanning in which a dummy raster period is inserted into the horizontal synchronizing signals Hs, and in which the phase of the vertical synchronizing signal VS is shifted by half the horizontal scanning period for alternate fields, to provide so-called interlace scanning. For this purpose, the interlace control circuit 12 has the function of discriminating between odd-numbered field periods and even-numbered field periods. This function can be easily obtained by using a binary flip-flop FDFF which is incremented by the vertical synchronizing signal, for instance. Accordingly, an odd-numbered field (or an even-numbered field) detection signal Vi activated only during an odd-numbered field period (or an even-numbered field period), for instance, can be obtained for each frame from the interlace control circuit 12.

When the logical "and" product of the odd-numbered field detection signal Vi obtained from the interlace control circuit 12 and the pulse signal $P_2$ output during each circulation period of the second scanning counter $C_2$ is produced by the AND gate $G_1$, odd-numbered vertical synchronizing signals alone are extracted. The odd-numbered vertical synchronizing signals thus extracted are supplied, as the external synchronizing signals Ex, out of the display control device 10 through the terminal-switching circuit 16.

The above is the description of the elements outputting the external synchronizing signals Ex, but the display control circuit 10 is also constructed so that it receives synchronizing signals Ex from external equipment. These synchronizing signals Ex from external equipment are formed of odd-numbered (or even-numbered) vertical synchronizing signals alone, in the same way as the signals Ex output externally. The external synchronizing signal Ex is inputted to the pulse cut-out circuit 14 through the terminal-switching circuit 16. Within the pulse cut-out circuit 14, a narrow pulse is cut out from the external synchronizing signal Ex, and this pulse is distributed as a clear signal (reset or initialization signal) CR to the counters $C_0$, $C_1$ and $C_2$. Therefore, the counts $D_0$, $D_1$, and $D_2$ of the counters $C_0$, $C_1$, and $C_2$ are initialized (reset to 0 or an initial value) simultaneously in synchronization with the external signal Ex, when the external synchronizing signal is inputted thereto. The binary flip-flop FDFF in the interlace controller is initialized to its initial state in response to the reset signal CR derived from the pulse cut-out circuit 14. Thus, when the external synchronizing signal is inputted to the CRTC, the counters C to $C_1$ are reset to initial state and the binary counter FDFF is reset to initial state directed to even field (or odd field).

This initialization is effected in each frame if the external synchronizing signal Ex is generated, for instance, from another display control device 10 of the same construction. Therefore, even if a count error occurs in one or more of the counters $C_0$, $C_1$, and $C_2$, it is corrected automatically when the subsequent frame period starts. Consequently, mutual synchronization of a plurality of display control devices can be secured continuously, and thus image data stored in a plurality of memories can always be superposed with the correct positional relationship for display. As a result, a plurality of images can be synthesized into a complicated image or diversified images in a simple manner and at high speed.

In this embodiment, the switching state of the terminal switching circuit 16 determines whether the synchronizing signal Ex is outputted externally or is inputted from another display control device 10. The switching state of the terminal-switching circuit 16 is controlled by a control signal $R_4$ which is set by the group of registers 22. Accordingly, whether the display control device 10 is used as a master or a slave can be determined freely by setting the group of registers 22, which is done when the device is used. On the other hand, the number of signal terminals required for the mutual synchronization of a plurality of display control devices can be reduced to one.

Figure 2:
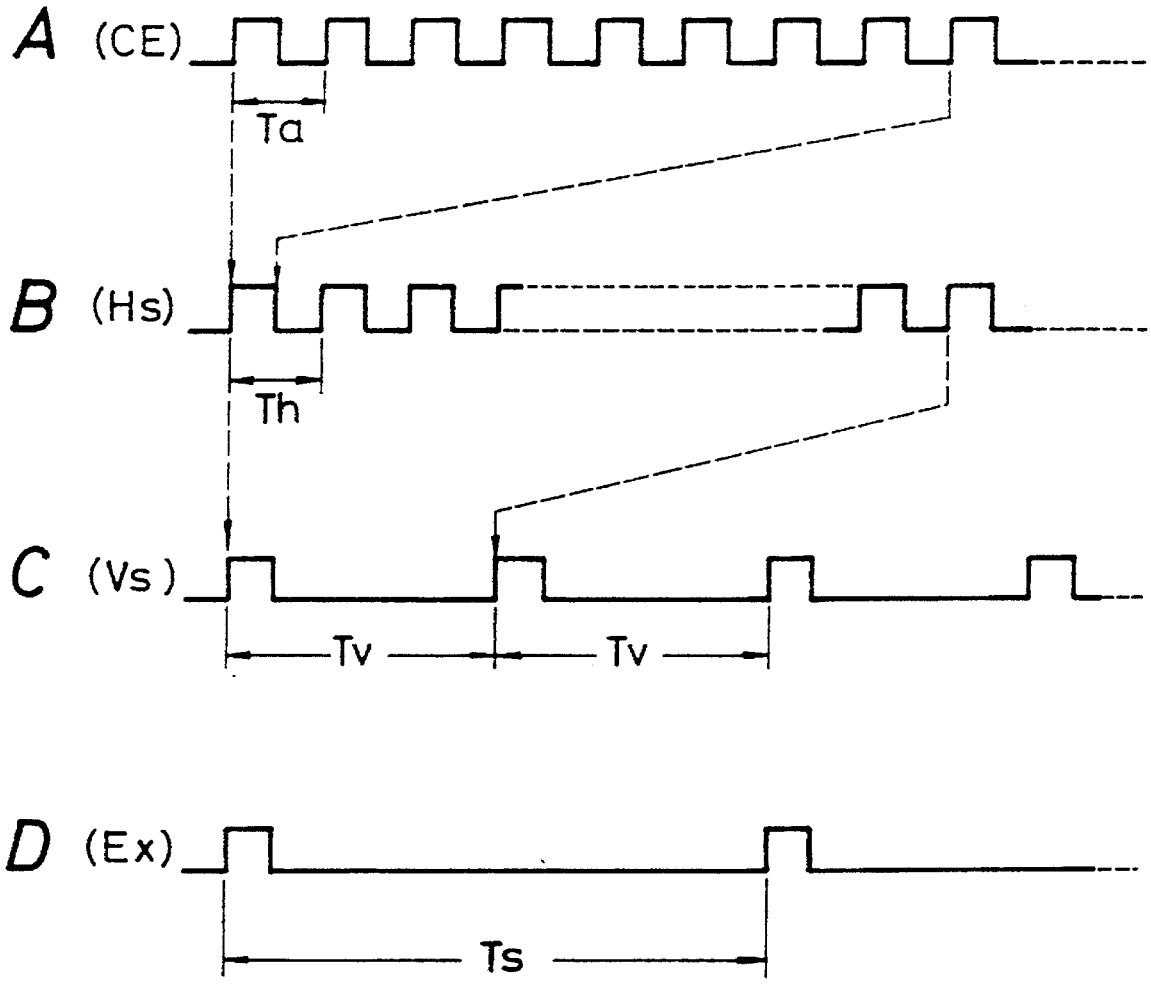
FIG. 2(*a–d*) is a timing chart of an example of the operation of the device of FIG. 1.

FIG. 2 is a timing chart of an example of the operation of the display control device described above. In this figure, Ta denotes the access cycle of the memory, Th denotes the horizontal scanning period, Tv denotes the field period, and Ts denotes the period of the external synchronizing signal Ex delivered within each frame.

In the foregoing explanation, reference has been made to the periodic initialization of the scanning counters by the synchronizing signal Ex. In this regard, it should be understood that such initialization could comprise a simple resetting of the scanning counters to zero, but also includes a forcing of the state of the scanning counters to a prescribed value. In the latter case, the addresses generated by one CRTC need not be the same as those generated by another CRTC in the system, which allows data stored in different locations of the same or different memories to be displayed in superposition.

Figure 3:
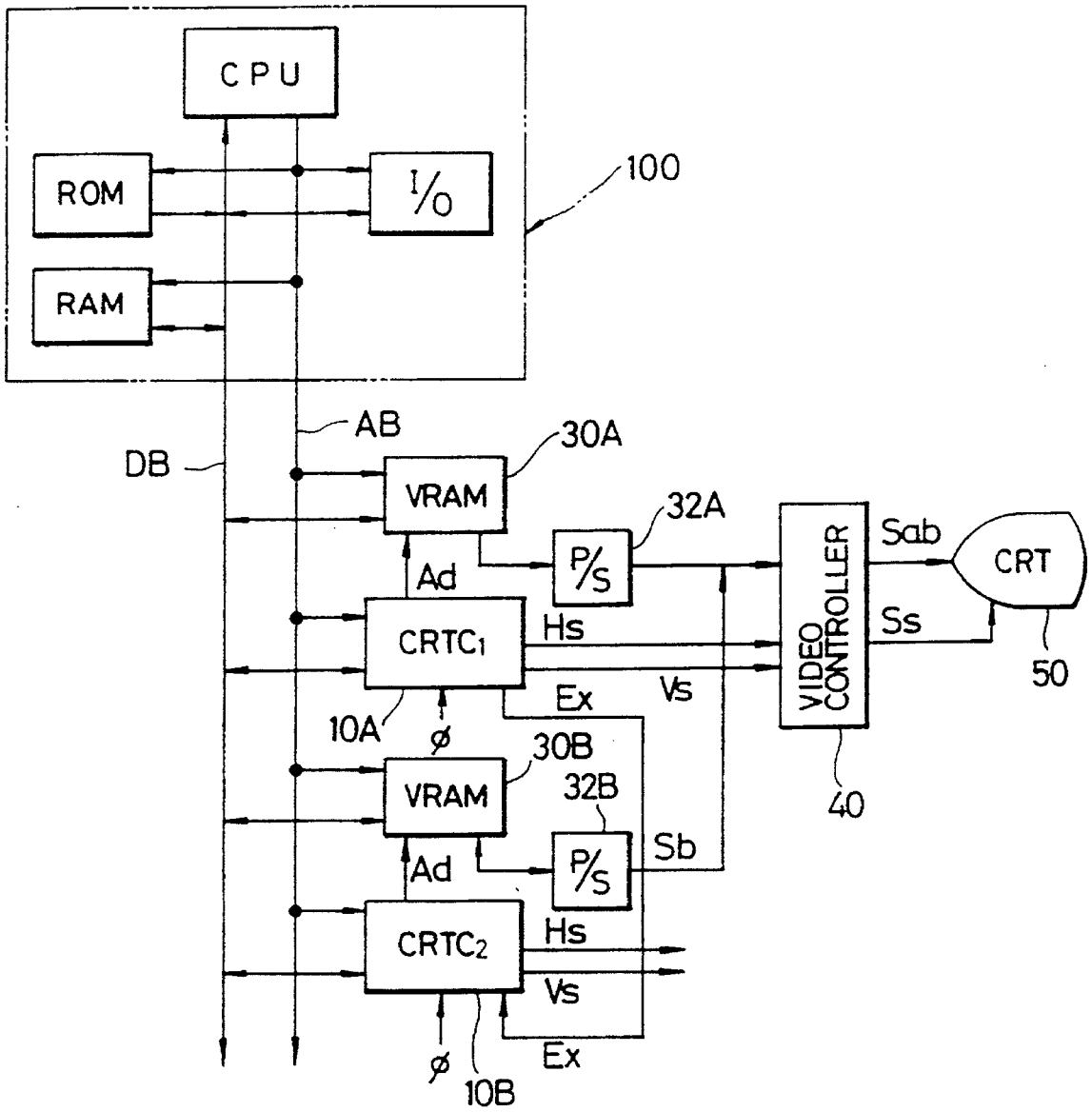
FIG. 3 is a block diagram of a system showing an example of the employment of the display control device of the present invention.

FIG. 3 shows an example of a system for employment of the display control device 10. In the example of this figure, two display control devices 10A and 10B are used. These display control devices 10A and 10B are connected to an address bus AB and data bus DB of a computer system 100, so that they can operate as peripheral devices of the computer system 100. The computer system 100 consists of, for example, a CPU, a ROM, a RAM and an I/0 port.

The display control devices (CRTC1 and CRTC2). 10A and 10B control memories (RAMs) 30A and 30B storing image data, respectively. The image data read out from the memories 30A and 30B is converted into serial image signals Sa and Sb by parallel-serial conversion circuits (P/S conversion circuits) 32A and 32B, respectively, which signals are then inputted to a video controller 40, together with vertical and horizontal synchronizing signals Hs and Vs output from the display control device 10A. The video controller 40 prepares an image signal Sab and a synchronizing signal Ss for the CRT display device 50 from these input signals. Thus, the image data Sa and Sb read out from the two memories 30A and 30B is displayed in a mutually-superposed state on the CRT display device 50.

Here, one device 10A of the two display control devices 10A and 10B is set so that it outputs the synchronizing signal Ex externally within each frame period. While the other device 10B is set so that it receives, as an input, the external synchronizing signal Ex outputted from the-device 10A. In other words, when display control devices are employed, internal registers thereof are set by the computer system 100 so that the display control device 10A operates as the master and the display control device 10B operates as the slave. Thus, one display control device 10A operates as master and the other display control device 10B as slave, and the device 10B reliably follows the device 10A, in synchronization therewith.

Figure 4:
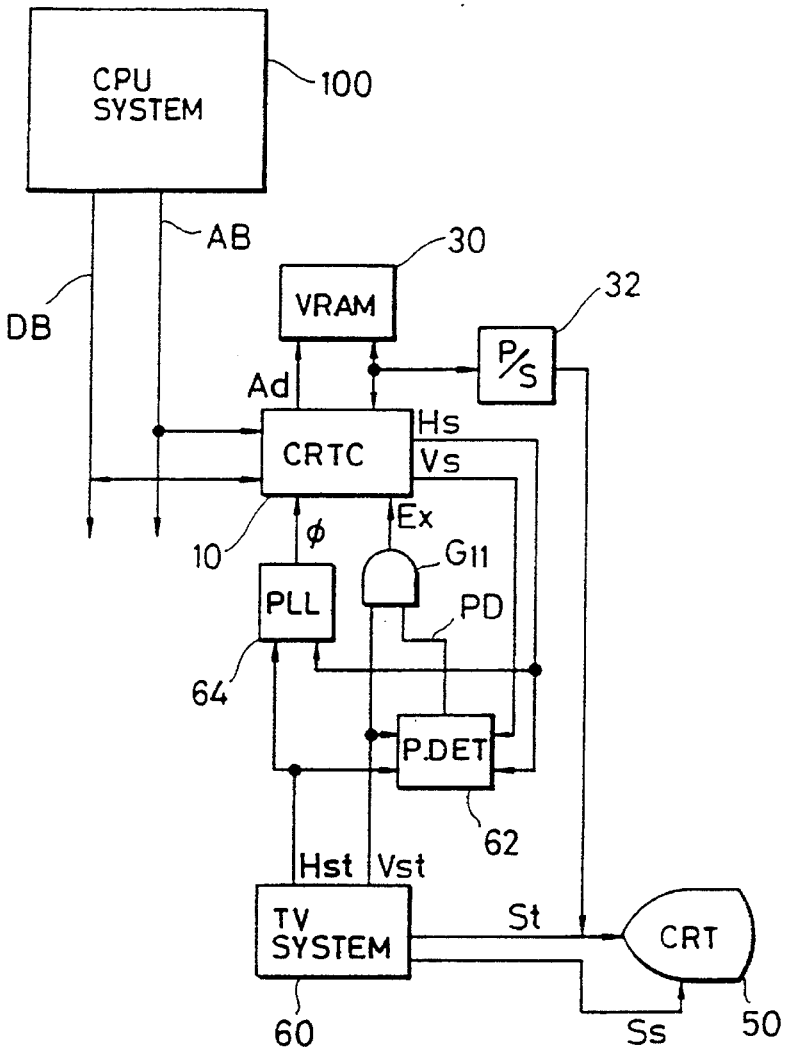
FIG. 4 is a schematic diagram of another embodiment of the present invention.

FIG. 4 shows another embodiment of the present invention. The embodiment shown in this figure uses the display control device 10 described above, and is constructed so that image data St to be displayed on a display system, such as a television system 60 which has the separate synchronizing signal system, and image data Sc controlled by the display control device 10 can be superposed for display in one CRT display device 50 while the mutual prescribed positional relationship thereof is maintained.

In order to display the image data stored in the memory 30 on a display device of an interlace scanning type whose image display is formed of horizontal scanning lines and vertical frames, i.e. a conventional CRT display device 50 in this case, the display control device 10 is provided with a scanning counter which is incremented at a period based on the timing of access to a memory 30 and whose count content circulates periodically. The display control device 10 is constructed so that the memory 30 is accessed by address data Ad produced on the basis of the count of the scanning counter, as already described. Horizontal and vertical synchronizing signals are also produced on the basis of the count of this scanning counter.

The television 60 causes the CRT display device 50 to display the image data St of the television system 60 side, using a synchronizing signal Ss which is prepared separately in the conventional manner.

The display control device 10 is employed together with a basic clock generation circuit 65 constructed by using a phase-difference detection circuit 62, an AND gate G11, and a PLL (phase locked loop) 64.

The basic clock generation circuit 65 prepares a basic clock $\phi$ for the display control device 10 based on a horizontal synchronizing signal Hst outputted from the television system 60. The display control device 10 produces an access control signal CE for the memory 30, address data Ad, and the vertical synchronizing signal Vs and horizontal synchronizing signal Hs from the basic clock $\phi$.

Figure 5:
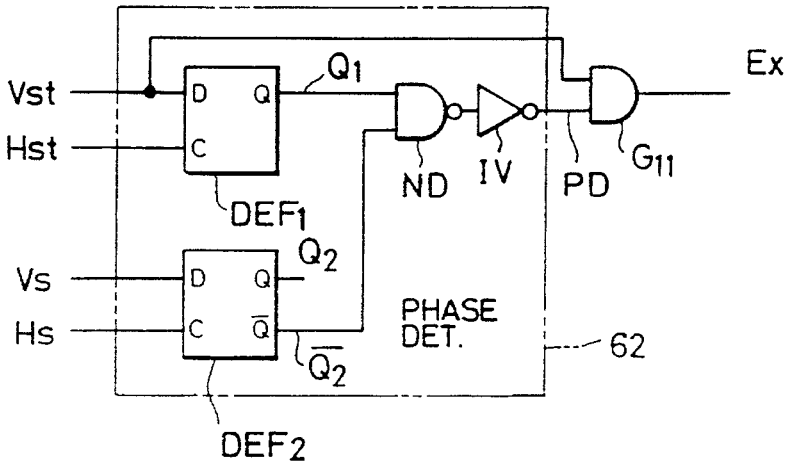
FIG. 5 is a schematic circuit diagram of the phase detector in the embodiment of FIG. 4.

The phase-difference detection circuit 62 detects any phase difference between the vertical synchronizing signal Vs outputted from the display control device 10 and the vertical synchronizing signal Vst outputted from the television system 60. The phase detector 62 comprises flip-flops $DFF_1$, $DFF_2$, a NAND circuit ND and an inverter IV, as shown in FIG. 5. The $DFF_1$ is employed for detecting the phase difference between the external vertical synchronizing signal Vst and the external horizontal synchronizing signal Hst. At the even field, the reading edge (time: t2) is preceded by the half period of the horizontal scanning period to that of the horizontal synchronizing signal Hst (time: t3), as shown in FIGS. 6A and 6B. On the other hand, at the odd field, the reading edge of the signal Vs and the reading edge of the signal Hst (time: t6) are coincident with each other.

The flip-flop $DFF_1$ receives the signal Vst and Hst at a data input terminal D and a clock input terminal C, respectively. Therefore, the reading edge (t3) of the output $Q_1$ of the flip-flop $DFF_1$ is delayed by half period with respect to the signal Vst at the even field as shown in the FIG. 6C. On the other hand, at the odd field, the reading edge of the signal $Q_2$ and the reading edge of the signal Vst are coincident with each other.

Figure 6:
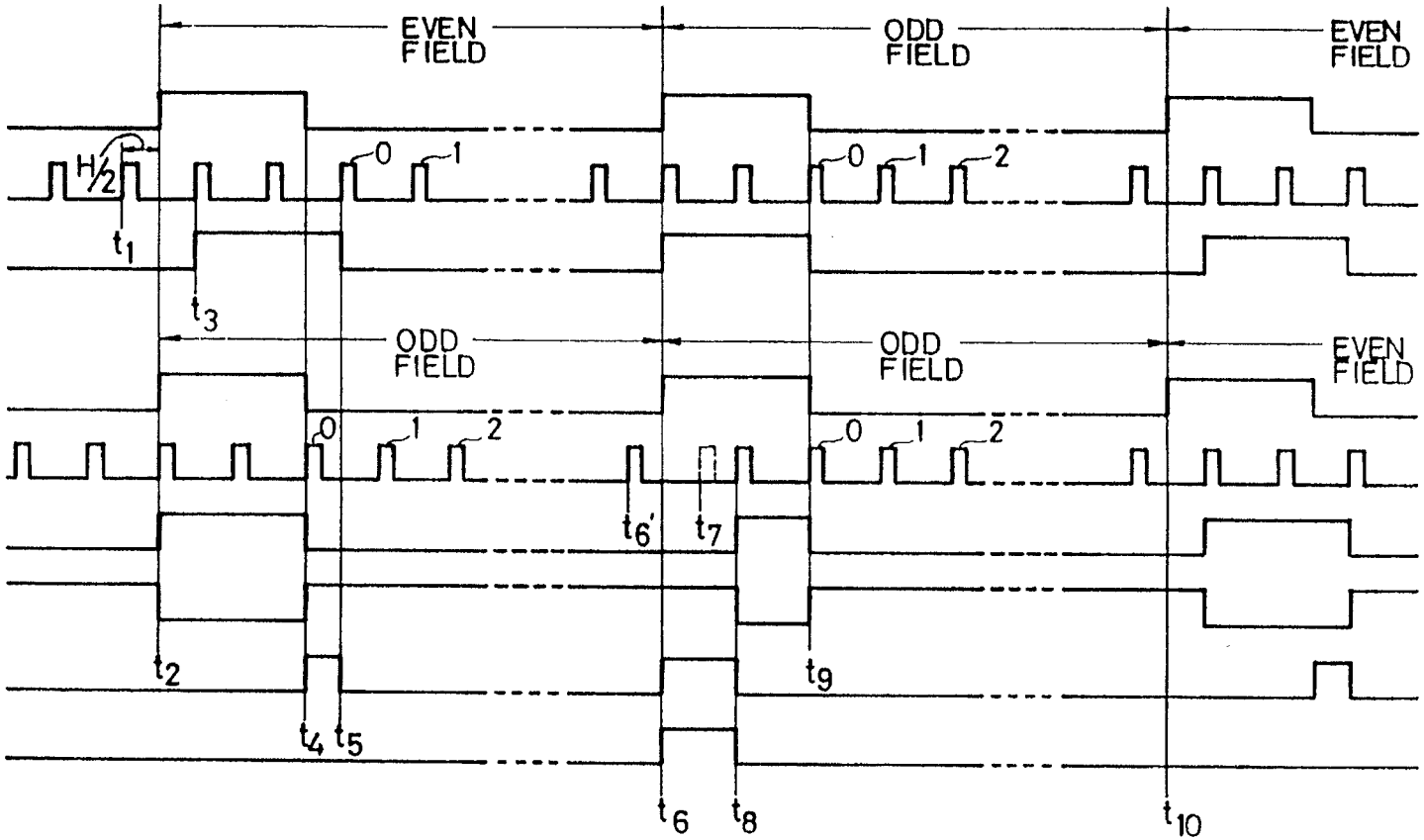
FIGS. 6(*a–i*) and 7(*a–c*) are timing charts of the operation of the circuit of FIG. 5.

The operation of the flip-flop $DFF_2$ is the same as that of the flip-flop $DFF_1$. The timing chart for the flip-flop $DFF_2$ is shown at FIGS. 6D to 6G. When the time period t2 to t6 represents an even field to the TV system 60 and an odd field to the CRTC 10, as shown in FIG. 6, the output $\overline{Q_2}$ becomes high at the time t4 and the output $Q_1$ becomes low at the time t5. In accordance with this, an output of the inverter IV becomes high during the period t4 to t5. In this case, the output Ex of the AND circuit $G_{11}$ is held to the low level, as shown in FIG. 61, since the external signal Vst falls to the low level at the time t4.

At time t6, the output PD of the inverter IV is raised to the high level again since the output $Q_1$ is raised at the time t6 to the high level and the output $\overline{Q_2}$ is held to the high level. Since, at the time t6, the external signal Vst is raised to the high level, the signal Ex is raised to the high level. According with this, the counters $C_0$ to $C_2$ and the flip-flop FDFF (FIG. 1) are reset to their initial state. The initial state of the flip-flop FDFF means the odd field. Thus, the odd field of the CRTC 10 is synchronized with that of the TV system 60 at time t6.

In accordance with the resetting operation, the horizontal synchronizing signal Hs is raised to the high level (t8) after one horizontal scanning period H to the time t6 (not at time t7 delayed one period. H to the time t6'). Since the output $\overline{Q_2}$ of the flip-flop $DFF_2$ falls at time t8 to the low level, the output Ex falls to the low level. When the odd or even field of the CRTC 10 is synchronized with the odd or even field of the TV system 60, the output Ex is held at the low level, as shown in FIG. 6I.

Figure 7:
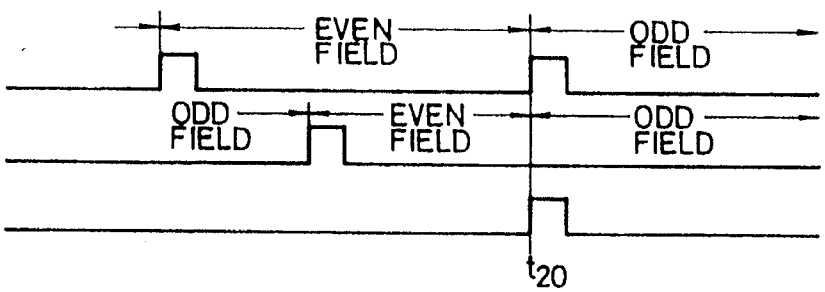

In the case where the phase difference between the Vst and Vs is large, as shown in FIG. 7, the output Ex is raised to the high level in synchronization with the signal Vst of the odd field. Therefore, the counters and flip-flop of the CRTC 10 are reset to their initial state at time t20.

As shown in FIG. 6, the phase-difference detection circuit 62 detects the phases of the vertical synchronizing signal Vs outputted from the display control device 10 and the vertical synchronizing signal Vst outputted from the television system 60, while comparing the relationships between the vertical synchronizing signals. (Whether the vertical synchronizing signals are odd-numbered or even-numbered is detected and a comparison is performed.) By taking the logical "and" product of the detection output of the phase-difference detection circuit 62 and the vertical synchronizing signal Vs outputted from the display control device 10, using the AND gate G11, a pulse output synchronous with the vertical synchronizing signal Vst can be obtained. This pulse output is inputted as the external synchronizing signal Ex to the display control device 10 so that the initialization timing of the count of each counter in the display control device 10 can be synchronized periodically with the odd-numbered (or even-numbered) vertical synchronizing signals on the television system side. Incidentally, the display control device 10 in this case is set beforehand so as to operate as the slave by an instruction given by the computer system 100, for example.

In this way, the image data St displayed in the display system which has a separate synchronizing signal system, like the television system 60, and the image data Sc controlled by the display control device 10 can be superposed for display on one image display screen with the prescribed mutual positional relationship thereof maintained.

As can be seen from the foregoing description, by applying a construction in which a memory is accessed by address data prepared on the basis of a count of a scanning counter, and horizontal and vertical synchronizing signals are each generated on the basis of the count of this scanning counter, the count of the scanning counter being initialized periodically to a prescribed value by a signal inputted from external equipment, a plurality of image data items controlled by each of a plurality of CRTCs can be superposed for display on one image display screen, with the prescribed mutual positional relationships thereof maintained.

By applying a construction in which a memory is accessed by address data prepared on the basis of a count of a scanning counter, and horizontal and vertical synchronizing signals are each generated on the basis of the count of this scanning counter, while a signal synchronous with either the odd-numbered or the even-numbered vertical synchronizing signals is outputted to external equipment, a plurality of image data items controlled by each of a plurality of CRTCs can be superposed for display on a display device of an interlace scanning system, with the prescribed mutual positional relationships thereof maintained.

Further, by applying a construction in which a memory is accessed by address data prepared on the basis of a count of a scanning counter horizontal and vertical synchronizing signals are given by a display system of an interlace scanning type which has a separate synchronizing signal system, and a clock signal determining the timing of access to the memory is prepared on the basis of the horizontal synchronizing signal, while either the odd-numbered or the even-numbered vertical synchronizing signals are detected from the vertical synchronizing signal and the count of the scanning counter is initialized forcibly to a prescribed value on the basis of the signals thus detected, image data displayed on the display system with the separate synchronizing signal system, like a television system, and image data controlled by a CRTC can be superposed for display on one image display screen with a prescribed mutual positional relationship maintained.

The effects described above enable the attainment of a synergistic effect in that a plurality of images can be synthesized into a complicated image or a wide variety of images in a simple manner and at high speed.

The above is a detailed description of the invention based on various embodiments thereof. This invention is not limited to these embodiments, of course, it can be varied in many ways within its fundamental scope. For instance, a liquid-crystal display device or a plasma display device can be used as the CRT display device, and the period of the external synchronizing signal Ex can be set to be several frames long, or any longer length of time.

The invention has been described above mainly in relation to the case in which it is adapted to the technique of synchronizing a display control device of a CRT display device, which is used as the background of the field of application thereof. The present invention is not limited to this application, it can be applied, for instance, to the technique of synchronizing a display control device which has an intelligent processing function which decides the content of image data and rewrites it. The present invention can be applied to any devices in which at least synchronization or alignment is a necessary condition.

We claim:

1. A display control device for use with a display device and a memory, wherein said display control device is formed of a semiconductor integrated circuit, and wherein said display control device accesses the memory to read out image data to be displayed on the display device as an image display formed of horizontal scanning lines with a preselected timing, said display control device comprising:

a terminal;

control means for indicating one of internal and external modes;

counter means, incremented at a rate based on a predetermined timing, for generating a count which is repeated in accordance with a predetermined timing, said counter means being settable to a predetermined value based on a signal applied to said terminal;

address generating means, responsive to said counter means, for generating sequential addresses for accessing said memory;

timing signal generating means, responsive to said counter means, for generating a synchronizing signal; and means, responsive to indication of the internal mode by said control means, for providing said synchronizing signal to said terminal, and responsive to indication of the external mode by said control means, for setting the count of said counter means with said predetermined value in accordance with a signal from said terminal.

2. A display control device for use with a display device and a memory, wherein said display control device accesses the memory to read out image data to be displayed on the display device as an image display formed of horizontal scanning lines with a preselected timing, said display control device comprising:

control means for indicating one of internal and external modes;

counter means, incremented at a rate based on a predetermined timing, for generating a count which is repeated in accordance with a predetermined timing, said counter means being settable to a predetermined value based on a signal from outside of said display control device;

address generating means, responsive to said counter means, for generating sequential addresses for accessing said memory;

timing signal generating means, responsive to said counter means, for generating a synchronizing signal; and means, responsive to indication of the internal mode by said control means, for providing said synchronizing signal to outside of said display control device, and responsive to indication of the external mode by said control means, for setting the count of said counter means with said predetermined value in accordance with a signal from said outside of said display control device.

3. A display control device for use with a display device and a memory, wherein the display control device is formed of a semiconductor integrated circuit, and wherein the display control device accesses the memory to read out image data to be displayed on the display device as an image display formed of horizontal scanning lines with a preselected timing, the display control device comprising:

terminal means for supplying a signal;

register means for storing first data to indicate a first reference value, second data to indicate a second reference value and third data to indicate one of internal and external modes;

horizontal counter means, incremented in response to a clock signal, for generating a count;

first comparator means for outputting a horizontal synchronizing signal which changes from a first level to a second level when the count generated from the horizontal counter means coincides with the first data;

vertical counter means, incremented in response to the horizontal synchronizing signal for generating a count;

second comparator means for outputting a vertical synchronizing signal which changes from a first level to a second level when the count generated from the vertical counter means coincides with the second data; and address generating means, responsive to signals from said horizontal and vertical counter means, for generating sequential addresses for accessing the memory, wherein the horizontal counter means is set with an initial value based on the horizontal synchronizing signal after the count generated from the horizontal counter means coincides with the first data, and the vertical counter means is set with an initial value based on the vertical synchronizing signal after the count generated from the vertical counter means coincides with the second data, when the third data indicates the internal mode, and wherein each of the horizontal and vertical counter means is set with the initial value in accordance with the signal supplied from the terminal means when the third data indicates the external mode.

4. The display control device according to claim 3, wherein the initial value is 0.

5. A display control device for use with a display device, and a memory, wherein the display control device accesses the memory to read out image data to be displayed on the display device as an image display formed of horizontal scanning lines with a preselected timing, the display control device comprising:

register means for storing first data to indicate a first reference value, second data to indicate a second reference value and third data to indicate one of internal and external modes;

horizontal counter means, incremented in response to a clock signal, for generating a count;

first comparator means for outputting a horizontal synchronizing signal which changes from a first level to a second level when the count generated from the horizontal counter means coincides with the first data;

vertical counter means, incremented in response to the horizontal synchronizing signal, for generating a count;

second comparator means for outputting a vertical synchronizing signal which changes from a first level to a second level when the count generated from the vertical counter means coincides with the second data; and address generating means, responsive to signals from said horizontal and vertical counter means, for generating sequential addresses for accessing the memory, wherein the horizontal counter means is set with an initial value based on the horizontal synchronizing signal after the count generated from the horizontal counter means coincides with the first data, and the vertical counter means is set with an initial value based on the vertical synchronizing signal after the count generated from the vertical counter means coincides with the second data, when the third data indicates the internal mode, and wherein each of the horizontal and vertical counter means is set with the initial value in accordance with a signal provided from the outside of the display control device when the third data indicates the external mode.

6. The display control device according to claim 5, wherein the register means comprises:

a first register which stores the first data, a second register which stores the second data, and a third register which stores the third data.

7. The display control device according to claim 6, wherein the initial value is 0.

8. A semiconductor integrated circuit device for use with a display device and a memory the semiconductor integrated circuit device accessing the memory to read out image data to be displayed on the display device as an image display formed of horizontal scanning lines with a preselected timing, the semiconductor integrated circuit device comprising:

terminal means for supplying a signal;

register means for storing first data with respect to a period at which the image data for one horizontal scanning line is read from the memory, second data with respect to a period at which the image data for the horizontal scanning lines of the display device is read out from the memory and third data indicating one of internal and external modes;

horizontal scanning counter means, coupled to receive a clock signal which changes between a first state and a second state at a predetermined frequency, for providing a count value by counting the clock signal changing from the first state to the second state;

first comparator means, coupled to receive the count value of the horizontal scanning counter means and to receive the first data, for providing a horizontal synchronizing signal which changes between a first level to a second level, wherein the horizontal synchronizing signal is temporarily changed from the first level to the second level when the count value of the horizontal scanning counter means is coincident with the first data;

vertical scanning counter means coupled to receive the horizontal synchronizing signal, and for providing a count value by counting the horizontal synchronizing signal changing from the first level to the second level;

second comparator means coupled to receive the count value of the vertical scanning counter means and to receive the second data, and for providing a vertical synchronizing signal which changes between a first potential and a second potentials wherein the vertical synchronizing signal is temporarily changed from the first potential to the second potential when the count value of the vertical scanning counter means is coincident with the second data; and address generating means, responsive to count operations of the horizontal and vertical scanning counter means, and for providing sequential address signals for accessing the memory, wherein the second level of the horizontal synchronizing signal makes the horizontal scanning counter means set with a predetermined value and the second potential of the vertical synchronizing signal makes the vertical scanning counter means set with the predetermined value, when the third data indicates the internal mode, and wherein the signal from the terminal means makes the horizontal and vertical scanning counter means set with the predetermined value when the third data indicates the external mode.

9. The semiconductor integrated circuit device according to claim 8, wherein the register means includes:

a first register for storing the first data therein;

a second register for storing the second data therein; and a third register for storing the third data therein.

10. The semiconductor integrated circuit device according to claim 9, wherein the initial value is 0.

11. A display control device for use with a display device and a memory, wherein the display control device is formed of a semiconductor integrated circuits and wherein the display control device accesses the memory to read out image data to be displayed on the display device as an image display formed of horizontal scanning lines with a preselected timing, the display control device comprising:

terminal means for supplying a signal;

register means for storing first data to indicate a first reference value, second data to indicate a second reference value and third data to indicate one of internal and external modes;

horizontal counter means, incremented at a rate based on a clock signal, for generating a count;

first comparator means for outputting a horizontal synchronizing signal which changes from a first level to a second level when the count generated from the horizontal counter means coincides with the first data, wherein the horizontal counter means is set with an initial value based on the horizontal synchronizing signal after the count generated from the horizontal counter means coincides with the first data;

vertical counter means, incremented at a rate based on the horizontal synchronizing signal, for generating a count;

second comparator means for outputting a vertical synchronizing signal which changes from a first level to a second level when the count generated from the vertical counter means coincides with the second data, wherein the vertical counter means is set with an initial value based on the vertical synchronizing signal after the count generated from the vertical counter means coincides with the second data;

address generating means, responsive to signals from the horizontal and vertical counter means, for generating sequential addresses for accessing the memory; and means, for providing a synchronizing signal which is synchronized to the vertical synchronizing signal, to the terminal means, in response to indication of the internal mode by the third data, and for setting the count of each of the horizontal and vertical counter means with the initial value in accordance with a signal from the terminal means, in response to indication of the external mode by the third data.

12. The display control device according to claim 11, wherein the register means comprises:

a first register which stores the first data;

a second register which stores the second data; and a third register which stores the third data.

13. The display control device according to claim 12, wherein the initial value is 0.

14. A display control device for use with a display device and a memory, wherein the display control device accesses the memory to read out image data to be displayed on the display device as an image display formed of horizontal scanning lines with a preselected timing, the display control device comprising:

register means for storing first data to indicate a first reference value, second data to indicate a second reference value and third data to indicate one of internal and external modes;

horizontal counter means, incremented at a rate based on a clock signal, for generating a count;

first comparator means for outputting a horizontal synchronizing signal which changes from a first level to a second level when the count generated from the horizontal counter means coincides with the first data, wherein the horizontal counter means is set with an initial value after the count generated from the horizontal counter means coincides with the first data;

vertical counter means, incremented at a rate based on the horizontal synchronizing signal, for generating a count;

second comparator means for outputting a vertical synchronizing signal which changes from a first level to a second level when the count generated from the vertical counter means coincides with the second data, wherein the vertical counter means is set with an initial value after the count generated from the vertical counter means coincides with the second data;

address generating means, responsive to signal from the horizontal and vertical counter means, for generating sequential addresses for accessing the memory; and means, for outputting a synchronizing signal which is synchronized to the vertical synchronizing signal, in response to indication of the internal mode by the third data, and for setting the count of each of the horizontal and vertical counter means with the initial value in accordance with a signal from the outside of the display control device, in response to indication of the external mode by the third data.

15. The display control device according to claim 14, wherein the register means comprises:

a first register which stores the first data;

a second register which stores the second data; and a third register which stores the third data.

16. The display control device according to claim 15, wherein the initial value is 0.

17. A semiconductor integrated circuit device for use with a display device and a memory the semiconductor integrated circuit device accessing the memory to read out image data to be displayed on the display device as an image display formed of horizontal scanning lines with a preselected timing, the semiconductor integrated circuit device comprising:

terminal means for supplying a signal;

register means for storing first data with respect to a period at which the image data for one horizontal scanning line is read from the memory, second data with respect to a period at which the image data for the horizontal scanning lines of the display device is read out from the memory, and third data indicating one of internal and external nodes;

horizontal scanning counter means, coupled to receive a clock signal which changes between a first state and a second state at a predetermined frequency, for providing a count value by counting the clock signal;

first comparator means coupled to receive the count value of the horizontal scanning counter means and to receive the first data, for providing a horizontal synchronizing signal which changes between a first level and a second level, wherein the horizontal synchronizing signal is temporarily changed from the first level and the second level when the count value of the horizontal scanning counter means is coincident with the first data, and wherein the second level of the horizontal synchronizing signal makes the horizontal scanning counter means set with a predetermined value;

vertical scanning counter means, coupled to receive the horizontal synchronizing signal, and for providing a count value by counting the horizontal synchronizing signal;

second comparator means, coupled to receive the count value of the vertical scanning counter means and to receive the second data, and for providing a vertical synchronizing signal which changes between a first potential to a second potential, wherein the vertical synchronizing signal is temporarily changed from the first potential to the second potential when the count value of the vertical scanning counter means is coincident with the second data, and wherein the second potential of the vertical synchronizing signal makes the vertical scanning counter means set with the predetermined value;

address generating means, responsive to count operations of the horizontal and vertical scanning counter means, and for providing sequential address signals for accessing the memory; and means for outputting to the terminal means a signal which is synchronized with the vertical synchronizing signal when the third data indicates the internal mode, and for inputting from the terminal means the signal for setting the count value of the horizontal and vertical scanning counter means to the predetermined value when the third data indicates the external mode.

18. The semiconductor integrated circuit device according to claim 17, wherein the register means includes:

a first register for storing the first data therein;

a second register for storing the second data therein; and a third register for storing the third data therein.

19. The semiconductor integrated circuit device according to claim 18, wherein the initial value is 0.

20. A display control device for use with a display device and a memory, wherein the display control device is formed of a semiconductor integrated circuit and wherein the display control device accesses the memory to read out image data to be displayed on the display device as an image display formed of horizontal scanning lines with a preselected timing, the display control device comprising:

register means for storing first data to indicate a first reference value second data to indicate a second reference value and third data to indicate one of internal and external modes;

first and second terminals for, respectively, supplying horizontal and vertical synchronizing signals;

horizontal counter means incremented in response to a clock signal, for generating a count;

vertical counter means, incremented in response to the horizontal synchronizing signal, for generating a count;

address generating means, responsive to signals from the horizontal and vertical counter means, for generating sequential addresses for accessing the memory;

means for, when the third data indicates the internal mode, setting the horizontal counter means with an initial value based on a signal related to the horizontal synchronizing signal which changes from a first level to a second level after the count generated from the horizontal counter means is indicated by comparing means to coincide with the first data and setting the vertical counter means with an initial value based on a signal related to the vertical synchronizing signal which changes from a first level to a second level to after the count generated from the vertical counter means is indicated by said comparing means to coincide with the second data; and means for, when the third data indicates the external mode, setting each of the horizontal and vertical counter means with an initial value in accordance with a signal provided from the outside of the display control device.

21. A display control device for use with a display device and a memory, wherein said display control device is formed of a semiconductor integrated circuit, and wherein said display control device accesses the memory to read out image data to be displayed on the display device as an image display formed of horizontal scanning lines with a preselected timing, said display control device comprising:

a terminal;

a control unit which indicates one of internal and external modes;

a counter unit, incremented at a rate based on a predetermined timing, which generates a count which is repeated in accordance with a predetermined timing, said counter unit being settable to a predetermined value based on a signal applied to said terminal;

an address generating unit, responsive to said counter unit, which generates sequential addresses, which accesses said memory;

a timing signal generating unit, responsive to said counter unit, which generates a synchronizing signal; and an input/output unit, responsive to indication of the internal mode by said control unit, which provides said synchronizing signal to said terminal, and responsive to indication of the external mode by said control unit, which sets the count of said counter unit with said predetermined value in accordance with a signal from said terminal.

22. A display control device for use with a display device and a memory, wherein said display control device accesses the memory to read out image data to be displayed on the display device as an image display formed of horizontal scanning lines with a preselected timing, said display control device comprising:

a control unit which indicates one of internal and external modes;

a counter unit, incremented at a rate based on a predetermined timing, which generates a count which is repeated in accordance with a predetermined timing, said counter unit being settable to a predetermined value based on a signal from outside of said display control device;

an address generating unit, responsive to said counter unit, which generates sequential addresses, which accesses said memory;

a timing signal generating unit, responsive to said counter unit, which generates a synchronizing signal; and an input/output unit, responsive to indication of the internal mode by said control unit, which provides said synchronizing signal to outside of said display control device, and responsive to indication of the external mode by said control unit, which sets the count of said counter unit with said predetermined value in accordance with a signal from said outside of said display control device.

23. A display control device for use with a display device and a memory, wherein the display control device is formed of a semiconductor integrated circuit, and wherein the display control device accesses the memory to read out image data to be displayed on the display device as an image display formed of horizontal scanning lines with a preselected timing, the display control device comprising:

a terminal which supplies a signal;

a register unit which stores first data to indicate a first reference value, second data to indicate a second reference value and third data to indicate one of internal and external modes;

a horizontal counter unit, incremented in response to a clock signal, which generates a count;

a first comparator unit which outputs a horizontal synchronizing signal which changes from a first level to a second level when the count generated from the horizontal counter unit coincides with the first data;

a vertical counter unit, incremented in response to the horizontal synchronizing signal, which generates a count;

a second comparator unit which outputs a vertical synchronizing signal which changes from a first level to a second level when the count generated from the vertical counter unit coincides with the second data; and an address generating unit, responsive to signals from said horizontal and vertical counter units, which generates sequential addresses which accesses the memory, wherein the horizontal counter unit is set with an initial value based on the horizontal synchronizing signal after the count generated from the horizontal counter unit coincides with the first data, and the vertical counter unit is set with an initial value based on the vertical synchronizing signal after the count generated from the vertical counter unit coincides with the second data, when the third data indicates the internal mode, and wherein each of the horizontal and vertical counter units is set with the initial value in accordance with the signal supplied from the terminal when the third data indicates the external mode.

24. The display control device according to claim 23, wherein the initial value is 0.

25. A display control device for use with a display device, and a memory, wherein the display control device accesses the memory to read out image data to be displayed on the display device as an image display formed of horizontal scanning lines with a preselected timing, the display control device comprising:

a register unit which stores first data to indicate a first reference value, second data to indicate a second reference value and third data to indicate one of internal and external modes;

a horizontal counter unit, incremented in response to a clock signal, which generates a count;

a first comparator unit which outputs a horizontal synchronizing signal which changes from a first level to a second level when the count generated from the horizontal counter unit coincides with the first data;

a vertical counter unit, incremented in response to the horizontal synchronizing signal, which generates a count;

a second comparator unit which outputs a vertical synchronizing signal which changes from a first level to a second level when the count generated from the vertical counter unit coincides with the second data; and an address generating unit, responsive to signals from said horizontal and vertical counter units, which generates sequential addresses, which accesses the memory, wherein the horizontal counter unit is set with an initial value based on the horizontal synchronizing signal after the count generated from the horizontal counter unit coincides with the first data, and the vertical counter unit is set with an initial value based on the vertical synchronizing signal after the count generated from the vertical counter unit coincides with the second data, when the third data indicates the internal mode, and wherein each of the horizontal and vertical counter units is set with the initial value in accordance with a signal provided from the outside of the display control device when the third data indicates the external mode.

26. The display control device according to claim 25, wherein the register unit comprises:

a first register which stores the first data;

a second register which stores the second data; and a third register which stores the third data.

27. The display control device according to claim 26, wherein the initial value is 0.

28. A semiconductor integrated circuit device for use with a display device and a memory, the semiconductor integrated circuit device accessing the memory to read out image data to be displayed on the display device as an image display formed of horizontal scanning lines with a preselected timing, the semiconductor integrated circuit device comprising:

a terminal which supplies a signal;

a register unit which stores first data with respect to a period at which the image data for one horizontal scanning line is read from the memory, second data with respect to a period at which the image data for the horizontal scanning lines of the display device is read out from the memory, and third data indicating one of internal and external modes;

a horizontal scanning counter unit, coupled to receive a clock signal which changes between a first state and a second state at a predetermined frequency, which provides a count value by counting the clock signal changing from the first state to the second state;

a first comparator unit, coupled to receive the count value of the horizontal scanning counter unit and to receive the first data, which provides a horizontal synchronizing signal which changes between a first level to a second level, wherein the horizontal synchronizing signal is temporarily changed from the first level and the second level when the count value of the horizontal scanning counter unit is coincident with the first data;

a vertical scanning counter unit coupled and receive the horizontal synchronizing signal, and which provides a count value by counting the horizontal synchronizing signal changing from the first level to the second level;

a second comparator unit, coupled to receive the count value of the vertical scanning counter unit and to receive the second data, and which provides a vertical synchronizing signal which changes between a first potential and a second potential, wherein the vertical synchronizing signal is temporarily changed from the first potential to the second potential when the count value of the vertical scanning counter unit is coincident with the second data; and an address generating unit, responsive to count operations of the horizontal and vertical scanning counter units, and which provides sequential address signals for accessing the memory, wherein the second level of the horizontal synchronizing signal makes the horizontal scanning counter unit set with a predetermined value, and the second potential of the vertical synchronizing signal makes the vertical scanning counter unit set with the predetermined value, when the third data indicates the internal mode, and wherein the signal from the terminal makes the horizontal and vertical scanning counter units set with the predetermined value when the third data indicates the external mode.

29. The semiconductor integrated circuit device according to claim 28, wherein the register unit includes:

a first register which storing the first data therein;

a second register which stores the second data therein; and a third register which stores the third data therein.

30. The semiconductor integrated circuit device according to claim 29, wherein the initial value is 0.

31. A display control device for use with a display device and a memory, wherein the display control device is formed of a semiconductor integrated circuit, and wherein the display control device accesses the memory to read out image data to be displayed on the display device as an image display formed of horizontal scanning lines with a preselected timing, the display control device comprising:

a terminal which supplies a signal;

a register unit which stores first data to indicate a first reference value, second data to indicate a second reference value and third data to indicate one of internal and external modes;

a horizontal counter unit, incremented at a rate based on a clock signal, which generates a count;

a first comparator unit which outputs a horizontal synchronizing signal which changes from a first level to a second level when the count generated from the horizontal counter unit coincides with the first data, wherein the horizontal counter unit is set with an initial value based on the horizontal synchronizing signal after the count generated from the horizontal counter unit coincides with the first data;

a vertical counter unit, incremented at a rate based on the horizontal synchronizing signal, which generates a count;

a second comparator unit which outputs a vertical synchronizing signal which changes from a first level to a second level when the count generated from the vertical counter unit coincides with the second data, wherein the vertical counter unit is set with an initial value based on the vertical synchronizing signal after the count generated from the vertical counter unit coincides with the second data;

an address generating unit, responsive to signals from the horizontal and vertical counter units, which generates sequential addresses, which accesses the memory; and an input/output unit, which provides a synchronizing signal which is synchronized to the vertical synchronizing signal, to the terminal, in response to indication of the internal mode by the third data, and which sets the count of each of the horizontal and vertical counter unit with the initial value in accordance with a signal from the terminal, in response to indication of the external mode by the third data.

32. The display control device according to claim 31, wherein the register unit comprises:

a first register which stores the first data;

a second register which stores the second data; and a third register which stores the third data.

33. The display control device according to claim 32, wherein the initial value is 0.

34. A display control device for use with a display device and a memory, wherein the display control device accesses the memory to read out image data to be displayed on the display device as an image display formed of horizontal scanning lines with a preselected timing, the display control device comprising:

a register unit which stores first data to indicate a first reference value, second data to indicate a second reference value and third data to indicate one of internal and external modes;

a horizontal counter unit, incremented at a rate based on a clock signal, which generates a count;

a first comparator unit which outputs a horizontal synchronizing signal which changes from a first level to a second level when the count generated from the horizontal counter unit coincides with the first data, wherein the horizontal counter unit is set with an initial value after the count generated from the horizontal counter unit coincides with the first data;

a vertical counter unit, incremented at a rate based on the horizontal synchronizing signal, which generates a count;

a second comparator unit which outputs a vertical synchronizing signal which changes from a first level to a second level when the count generated from the vertical counter unit coincides with the second data, wherein the vertical counter unit is set with an initial value after the count generated from the vertical counter unit coincides with the second data;

an address generating unit, responsive to signal from the horizontal and vertical counter units, which generates sequential addresses, which accesses the memory; and an input/output unit, which outputs a synchronizing signal which is synchronized to the vertical synchronizing signal, in response to indication of the internal mode by the third data, and which sets the count of each of the horizontal and vertical counter units with the initial value in accordance with a signal from the outside of the display control device, in response to indication of the external mode by the third data.

35. The display control device according to claim 34, wherein the register comprises:

a first register which stores the first data;

a second register which stores the second data; and a third register which stores the third data.

36. The display control device according to claim 35, wherein the initial value is 0.

37. A semiconductor integrated circuit device for use with a display device and a memory, the semiconductor integrated circuit device accessing the memory to read out image data to be displayed on the display device as an image display formed of horizontal scanning lines with a preselected timing, the semiconductor integrated circuit device comprising:

a terminal which supplies a signal;

a register unit which stores first data with respect to a period at which the image data for one horizontal scanning line is read from the memory, second data with respect to a period at which the image data for the horizontal scanning lines of the display device is read out from the memory and third data indicating one of internal and external modes;

a horizontal scanning counter unit, coupled to receive a clock signal which changes between a first state and a second state at a predetermined frequency, which provides a count value by counting the clock signal;

a first comparator unit, coupled to receive the count value of the horizontal scanning counter unit and receive the first data, which provides a horizontal synchronizing signal which changes between a first level to a second level, wherein the horizontal synchronizing signal is temporarily changed from the first level and the second level when the count value of the horizontal scanning counter unit is coincident with the first data, and wherein the second level of the horizontal synchronizing signal makes the horizontal scanning counter unit set with a predetermined value;

a vertical scanning counter unit, coupled to receive the horizontal synchronizing signal, and which provides a count value by counting the horizontal synchronizing signal;

a second comparator unit, coupled and receive the count value of the vertical scanning counter unit and to receive the second data, and which provides a vertical synchronizing signal which changes between a first potential to a second potential, wherein the vertical synchronizing signal is temporarily changed from the first potential to the second potential when the count value of the vertical scanning counter unit is coincident with the second data, and wherein the second potential of the vertical synchronizing signal makes the vertical scanning counter unit set with the predetermined value;

an address generating unit, responsive to count operations of the horizontal and vertical scanning counter units, and which provides sequential address signals for accessing the memory; and an input/output unit which outputs to the terminal a signal synchronized with the vertical synchronizing signal when the third data indicates the internal mode, and which inputs from the terminal the signal setting the count value of the horizontal and vertical scanning counter units to the predetermined value when the third data indicates the external mode.

38. The semiconductor integrated circuit device according to claim 37, wherein the register unit includes:

a first register which stores the first data therein;

a second register which stores the second data therein; and a third register which stores the third data therein.

39. The semiconductor integrated circuit device according to claim 38, wherein the initial value is 0.

40. A display control device for use with a display device and a memory, wherein the display control device is formed of a semiconductor integrated circuit, and wherein the display control device accesses the memory to read out image data to be displayed on the display device as an image display formed of horizontal scanning lines with a preselected timing, the display control device comprising:

a register unit which stores first data to indicate a first reference value second data to indicate a second reference value and third data to indicate one of internal and external modes;

a first and second terminals which supply horizontal and vertical synchronizing signals, respectively;

a horizontal counter unit, incremented in response to a clock signal, which generates a count;

a vertical counter unit, incremented in response to the horizontal synchronizing signal, which generates a count;

an address generating means, responsive to signals from the horizontal and vertical counter unit, which generates sequential addresses, which accesses the memory, wherein, when the third data indicates the internal mode, the horizontal counter unit is set with an initial value based on a signal related to the horizontal synchronizing signal which changes from a first level to a second level after the count generated from the horizontal counter unit is indicated by comparing unit to coincide with the first data and the vertical counter unit is set with an initial value based on a signal related to the vertical synchronizing signal which changes from a first level to a second level to after the count generated from the vertical counter unit is indicated by comparing unit to coincide with the second data, and wherein, when the third data indicates the external mode, each of the horizontal and vertical counter units is set with an initial value in accordance with a signal provided from the outside of the display control device.

41. A display control device for use with a display device and a memory, wherein said display control device is formed of a semiconductor integrated circuit, and wherein said display control device accesses the memory to read out image data to be displayed on the display device as an image display formed of horizontal scanning lines with a preselected timing, said display control device comprising:

a terminal;

a controller which indicates one of internal and external modes;

a counter which is incremented at a rate based on a predetermined timing, which generates a count which is repeated in accordance with a predetermined timing and which is settable to a predetermined value based on a signal applied to said terminal;

an address generator which is responsive to said counter and which generates sequential addresses for accessing said memory;

a timing signal generator, responsive to said counter, which generates a synchronizing signal; and an input/output circuit which is responsive to indication of the internal mode by said controller and provides said synchronizing signal to said terminal, and which is responsive to indication of the external mode by said controller and sets the count of said counter with said predetermined value in accordance with a signal from said terminal.

42. A display control device for use with a display device and a memory, wherein said display control device accesses the memory to read out image data to be displayed on the display device as an image display formed of horizontal scanning lines with a preselected timing, said display control device comprising:

a controller which indicates one of internal and external modes;

a counter which is incremented at a rate based on a predetermined timing, which generates a count which is repeated in accordance with a predetermined timing, said counter being settable to a predetermined value based on a signal from outside of said display control device;

an address generator which is responsive to said counter and which generates sequential addresses for accessing said memory;

a timing signal generator which is responsive to said counter and generates a synchronizing signal; and an input/output circuit which is responsive to indication of the internal mode by said controller and provides said synchronizing signal to outside of said display control device, and which is responsive to indication of the external mode by said controller and sets the count of said counter with said predetermined value in accordance with a signal from said outside of said display control device.

43. A display control device for use with a display device and a memory, wherein the display control device is formed of a semiconductor integrated circuit, and wherein the display control device accesses the memory to read out image data to be displayed on the display device as an image display formed of horizontal scanning lines with a preselected timing, the display control device comprising:

a terminal which supplies a signal;

a register which stores first data to indicate a first reference value, second data to indicate a second reference value and third data to indicate one of internal and external modes;

a horizontal counter which is incremented in response to a clock signal and which generates a count;

a first comparator which outputs a horizontal synchronizing signal which changes from a first level to a second level when the count generated from the horizontal counter coincides with the first data;

a vertical counter which is incremented in response to the horizontal synchronizing signal and which generates a count;

a second comparator which outputs a vertical synchronizing signal which changes from a first level to a second level when the count generated from the vertical counter coincides with the second data; and an address generator which is responsive to signals from said horizontal and vertical counters and generates sequential addresses for accessing the memory, wherein the horizontal counter is set with an initial value based on the horizontal synchronizing signal after the count generated from the horizontal counter coincides with the first data, and the vertical counter is set with an initial value based on the vertical synchronizing signal after the count generated from the vertical counter coincides with the second data, when the third data indicates the internal mode, and wherein each of the horizontal and vertical counters is set with the initial value in accordance with the signal supplied from the terminal when the third data indicates the external mode.

44. The display control device according to claim 43, wherein the initial value is 0.

45. A display control device for use with a display device, and a memory, wherein the display control device accesses the memory to read out image data to be displayed on the display device as an image display formed of horizontal scanning lines with a preselected timing, the display control device comprising:

a register storing first data to indicate a first reference value, second data to indicate a second reference value and third data to indicate one of internal and external modes;

a horizontal counter incremented in response to a clock signal and generating a count;

a first comparator outputting a horizontal synchronizing signal which changes from a first level to a second level when the count generated from the horizontal counter coincides with the first data;

a vertical counter incremented in response to the horizontal synchronizing signal and generating a count;

a second comparator outputting a vertical synchronizing signal which changes from a first level to a second level when the count generated from the vertical counter coincides with the second data; and an address generator responsive to signals from said horizontal and vertical counters and generating sequential addresses for accessing the memory, wherein the horizontal counter is set with an initial value based on the horizontal synchronizing signal after the count generated from the horizontal counter coincides with the first data, and the vertical counter is set with an initial value based on the vertical synchronizing signal after the count generated from the vertical counter coincides with the second data, when the third data indicates the internal mode, and wherein each of the horizontal and vertical counters is set with the initial value in accordance with a signal provided from the outside of the display control device when the third data indicates the external mode.

46. The display control device according to claim 45, wherein the register comprises:

a first area which stores the first data;

a second area which stores the second data; and a third area which stores the third data.

47. The display control device according to claim 46, wherein the initial value is 0.

48. A semiconductor integrated circuit device for use with a display device and a memory, the semiconductor integrated circuit device accessing the memory to read out image data to be displayed on the display device as an image display formed of horizontal scanning lines with a preselected timing, the semiconductor integrated circuit device comprising:

a terminal which supplies a signal;

a register which stores first data with respect to a period at which the image data for one horizontal scanning line is read from the memory, second data with respect to a period at which the image data for the horizontal scanning lines of the display device is read out from the memory, and third data indicating one of internal and external modes;

a horizontal scanning counter which is coupled to receive a clock signal which changes between a first state and a second state at a predetermined frequency, and which provides a count value by counting the clock signal changing from the first state to the second state;

a first comparator which is coupled to receive the count value of the horizontal scanning counter and to receive the first data, and which provides a horizontal synchronizing signal which changes between a first level to a second level, wherein the horizontal synchronizing signal is temporarily changed from the first level and the second level when the count value of the horizontal scanning counter is coincident with the first data;

a vertical scanning counter which is coupled to receive the horizontal synchronizing signal, and which provides a count value by counting the horizontal synchronizing signal changing from the first level to the second level;

a second comparator which is coupled to receive the count value of the vertical scanning counter and to receive the second data, and which provides a vertical synchronizing signal which changes between a first potential and a second potential, wherein the vertical synchronizing signal is temporarily changed from the first potential to the second potential when the count value of the vertical scanning counter is coincident with the second data; and an address generator which is responsive to count operations of the horizontal and vertical scanning counters, and which provides sequential address signals for accessing the memory, wherein the second level of the horizontal synchronizing signal makes the horizontal scanning counter set with a predetermined value, and the second potential of the vertical synchronizing signal makes the vertical scanning counter set with the predetermined value, when the third data indicates the internal mode, and wherein the signal from the terminal makes the horizontal and vertical scanning counters set with the predetermined value when the third data indicates the external mode.

49. The semiconductor integrated circuit device according to claim 48, wherein the register includes:

a first area which stores the first data therein;

a second area which stores the second data therein; and a third area which stores the third data therein.

50. The semiconductor integrated circuit device according to claim 49, wherein the initial value is 0.

51. A display control device for use with a display device and a memory, wherein the display control device is formed of a semiconductor integrated circuit, and wherein the display control device accesses the memory to read out image data to be displayed on the display device as an image display formed of horizontal scanning lines with a preselected timing, the display control device comprising:

a terminal which supplies a signal;

a register which stores first data to indicate a first reference value, second data to indicate a second reference value and third data to indicate one of internal and external modes;

a horizontal counter which is incremented at a rate based on a clock signal, and which generates a count;

a first comparator which outputs a horizontal synchronizing signal which changes from a first level to a second level when the count generated from the horizontal counter coincides with the first data, wherein the horizontal counter is set with an initial value based on the horizontal synchronizing signal after the count generated from the horizontal counter coincides with the first data;

a vertical counter which is incremented at a rate based on the horizontal synchronizing signal, and which generates a count;

a second comparator which outputs a vertical synchronizing signal which changes from a first level to a second level when the count generated from the vertical counter coincides with the second data, wherein the vertical counter is set with an initial value based on the vertical synchronizing signal after the count generated from the vertical counter coincides with the second data;

an address generator which is responsive to signals from the horizontal and vertical counters, and which generates sequential addresses for accessing the memory; and an input/output which provides a synchronizing signal which is synchronized to the vertical synchronizing signal, to the terminal, in response to indication of the internal mode by the third data, and which sets the count of each of the horizontal and vertical counters with the initial value in accordance with a signal from the terminal, in response to indication of the external mode by the third data.

52. The display control device according to claim 51, wherein the register comprises:

a first area which stores the first data;

a second area which stores the second data; and a third area which stores the third data.

53. The display control device according to claim 52, wherein the initial value is 0.

54. A display control device for use with a display device and a memory, wherein the display control device accesses the memory to read out image data to be displayed on the display device as an image display formed of horizontal scanning lines with a preselected timing, the display control device comprising:

a register storing first data to indicate a first reference value, second data to indicate a second reference value and third data to indicate one of internal and external modes;

a horizontal counter incremented at a rate based on a clock signal, and generating a count;

a first comparator outputting a horizontal synchronizing signal which changes from a first level to a second level when the count generated from the horizontal counter coincides with the first data, wherein the horizontal counter is set with an initial value after the count generated from the horizontal counter coincides with the first data;

a vertical counter incremented at a rate based on the horizontal synchronizing signal and generating a count;

a second comparator outputting a vertical synchronizing signal which changes from a first level to a second level when the count generated from the vertical counter coincides with the second data, wherein the vertical counter is set with an initial value after the count generated from the vertical counter coincides with the second data;

an address generator responsive to signal from the horizontal and vertical counter and generating sequential addresses for accessing the memory; and an input/output circuit outputting a synchronizing signal which is synchronized to the vertical synchronizing signal, in response to indication of the internal mode by the third data, and setting the count of each of the horizontal and vertical counters with the initial value in accordance with a signal from the outside of the display control device, in response to indication of the external mode by the third data.

55. The display control device according to claim 54, wherein the register comprises:

a first area which stores the first data;

a second area which stores the second data; and a third area which stores the third data.

56. The display control device according to claim 55, wherein the initial value is 0.

57. A semiconductor integrated circuit device for use with a display device and a memory, the semiconductor integrated circuit device accessing the memory to read out image data to be displayed on the display device as an image display formed of horizontal scanning lines with a preselected timing, the semiconductor integrated circuit device comprising:

a terminal which supplies a signal;

a register which stores first data with respect to a period at which the image data for one horizontal scanning line is read from the memory, second data with respect to a period at which the image data for the horizontal scanning lines of the display device is read out from the memory and third data indicating one of internal and external modes;

a horizontal scanning counter which is coupled to receive a clock signal which changes between a first state and a second state at a predetermined frequency, and which provides a count value by counting the clock signal;

a first comparator which is coupled to receive the count value of the horizontal scanning counter and to receive the first data, and which provides a horizontal synchronizing signal which changes between a first level and a second level, wherein the horizontal synchronizing signal is temporarily changed from the first level to the second level when the count value of the horizontal scanning counter is coincident with the first data, and wherein the second level of the horizontal synchronizing signal makes the horizontal scanning counter set with a predetermined value;

a vertical scanning counter which is coupled to receive the horizontal synchronizing signal, and which provides a count value by counting the horizontal synchronizing signal;

a second comparator which is coupled to receive the count value of the vertical scanning counter and to receive the second data, and which provides a vertical synchronizing signal which changes between a first potential to a second potential, wherein the vertical synchronizing signal is temporarily changed from the first potential to the second potential when the count value of the vertical scanning counter is coincident with the second data, and wherein the second potential of the vertical synchronizing signal makes the vertical scanning counter set with the predetermined value;

an address generator which is responsive to count operations of the horizontal and vertical scanning counters, and which provides sequential address signals for accessing the memory; and an input/output circuit which outputs to the terminal a signal synchronized with the vertical synchronizing signal when the third data indicates the internal mode, and which inputs from the terminal the signal setting the count value of the horizontal and vertical scanning counters to the predetermined value when the third data indicates the external mode.

58. The semiconductor integrated circuit device according to claim 59, wherein the register includes:

a first area which stores the first data therein;

a second area which stores the second data therein; and a third area which stores the third data therein.

59. The semiconductor integrated circuit device according to claim 58, wherein the initial value is 0.

60. A display control device for use with a display device and a memory, wherein the display control device is formed of a semiconductor integrated circuit, and wherein the display control device accesses the memory to read out image data to be displayed on the display device as an image display formed of horizontal scanning lines with a preselected timing, the display control device comprising:

a register which stores first data to indicate a first reference value second data to indicate a second reference value and third data to indicate one of internal and external modes;

first and second terminals which supply horizontal and vertical synchronizing signals, respectively;

a horizontal counter which is incremented in response to a clock signal, and which generates a count;

a vertical counter, which is incremented in response to the horizontal synchronizing signal, and which generates a count;

an address generator, which is responsive to signals from the horizontal and vertical counters, and which generates sequential addresses, for accessing the memory, wherein, when the third data indicates the internal mode, the horizontal counter is set with an initial value based on a signal related to the horizontal synchronizing signal which changes from a first level to a second level after the count generated from the horizontal counter is indicated by a comparator to coincide with the first data and the vertical counter is set with an initial value based on a signal related to the vertical synchronizing signal which changes from a first level to a second level to after the count generated from the vertical counter is indicated by said comparator to coincide with the second data, and wherein, when the third data indicates the external mode, each of the horizontal and vertical counters is set with an initial value in accordance with a signal provided from the outside of the display control device.

* * * * *